US008556374B2

(12) United States Patent
Gras et al.

(10) Patent No.: US 8,556,374 B2
(45) Date of Patent: Oct. 15, 2013

(54) PRINTHEAD AIR BARRIER

(75) Inventors: Xavier Gros Gras, Barcelona (ES); Xavier Gasso Puchal, Barcelona (ES); Francesc Ros Cerro, Sant Vicent de Montait (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/415,429

(22) Filed: Mar. 8, 2012

(65) Prior Publication Data

US 2013/0235121 A1 Sep. 12, 2013

(51) Int. Cl.
*B41J 2/165* (2006.01)

(52) U.S. Cl.
USPC ..... 347/25; 347/34

(58) Field of Classification Search
USPC ..... 347/25, 34
See application file for complete search history.

(56) References Cited

U.S. PATENT DOCUMENTS

| | | | | |
|---|---|---|---|---|
| 4,369,450 | A | 1/1983 | Iwagami et al. | |
| 5,528,271 | A | 6/1996 | Ebisawa | |
| 6,491,364 | B2 | 12/2002 | Pietrzyk et al. | |
| 6,719,398 | B1 | 4/2004 | McElfresh et al. | |
| 6,962,403 | B2 | 11/2005 | Smith et al. | |
| 7,357,479 | B2 | 4/2008 | Brugue et al. | |
| 2003/0043230 | A1 * | 3/2003 | Koitabashi et al. | 347/37 |
| 2009/0295880 | A1 | 12/2009 | Hanchak et al. | |
| 2010/0066771 | A1 * | 3/2010 | Hiratsuka et al. | 347/1 |
| 2011/0109693 | A1 | 5/2011 | Ohnishi | |

* cited by examiner

*Primary Examiner* — Matthew Luu
*Assistant Examiner* — Alexander D Shenderov
(74) *Attorney, Agent, or Firm* — Steven R. Ormiston

(57) ABSTRACT

In one example, an air barrier system for a printhead assembly includes a source of pressurized air and multiple channels operatively connected to the air source to channel multiple streams of air between two printheads in the printhead assembly.

14 Claims, 6 Drawing Sheets

PRINTHEAD AIR BARRIER

BACKGROUND

Inkjet printers utilize printheads that include an array of tiny orifices through which ink is ejected on to paper or another print substrate. For some types of inks, it is desirable to treat the print substrate with a chemical agent that helps the ink adhere properly to the substrate or otherwise improves the condition of the substrate before or after ink is applied. Such treatment agents may be applied to the print substrate during printing operations through a printhead (or group of printheads) positioned near the ink printheads.

DRAWINGS

The same part numbers designate the same or similar parts throughout the figures.

DESCRIPTION

A new printhead assembly has been developed to help isolate treatment aerosol from ink aerosol near the printheads in an inkjet printer to prevent the unwanted mixing of the two substances in the region around the printheads. When a treatment agent is applied to the print substrate during printing operations through a printhead positioned near an ink printhead, some mixing of treatment aerosol and ink aerosol is possible in the region between the printheads and the print substrate. This is a particularly significant risk for scanning type inkjet printers in which the treatment printhead(s) and ink printheads are carried back and forth across the print substrate together on the same carriage. The strong chemical interaction between the two substances can cause unwanted crusty residues to form on the printheads. In the examples described below, a new printhead assembly is configured to introduce an air barrier into the print zone between the treatment printhead(s) and the ink printhead(s) to reduce aerosol mixing without changing the trajectory of the treatment agent or the ink and, thus, without degrading the quality of the printed image.

While examples of the new air barrier are described below with reference to inkjet printers using a substrate treatment agent, the invention is not limited to substrate treatment, inkjet printers or to a printhead assembly in general. Other examples of the new air barrier, and structures and systems for establishing the new air barrier are possible. Hence, the examples shown in the figures and described below illustrate but do not limit the invention, which is defined in the Claims following this Description.

As used in this document, a "printhead" means that part of an inkjet printer or other inkjet type dispenser that dispenses liquid from one or more openings, for example as drops or streams; a "print bar" means a structure or device holding a printhead or an arrangement of printheads that remains stationary during printing; and a "treatment agent" means a substance other than ink applied to a print substrate before, during, or after ink is applied to the substrate to change the condition of the substrate, for example to make ink adhere properly to the substrate. "Printhead" and "print bar" are not limited to printing with ink but also include inkjet type dispensing of other liquids and/or for uses other than printing.

Figure 1:
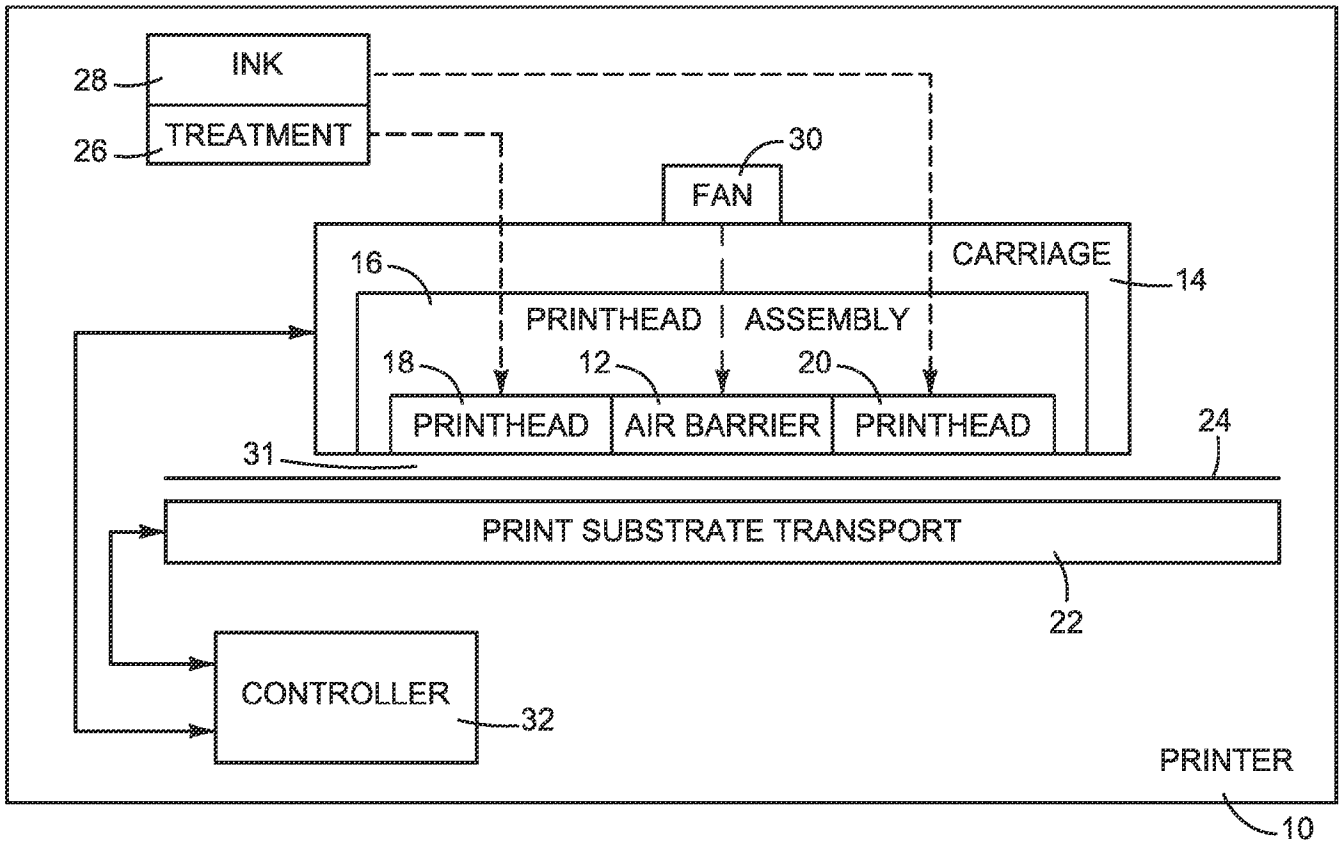
FIG. 1 is a block diagram illustrating one embodiment of an inkjet printer in which examples of the new printhead air barrier may be implemented.
Figure 2:
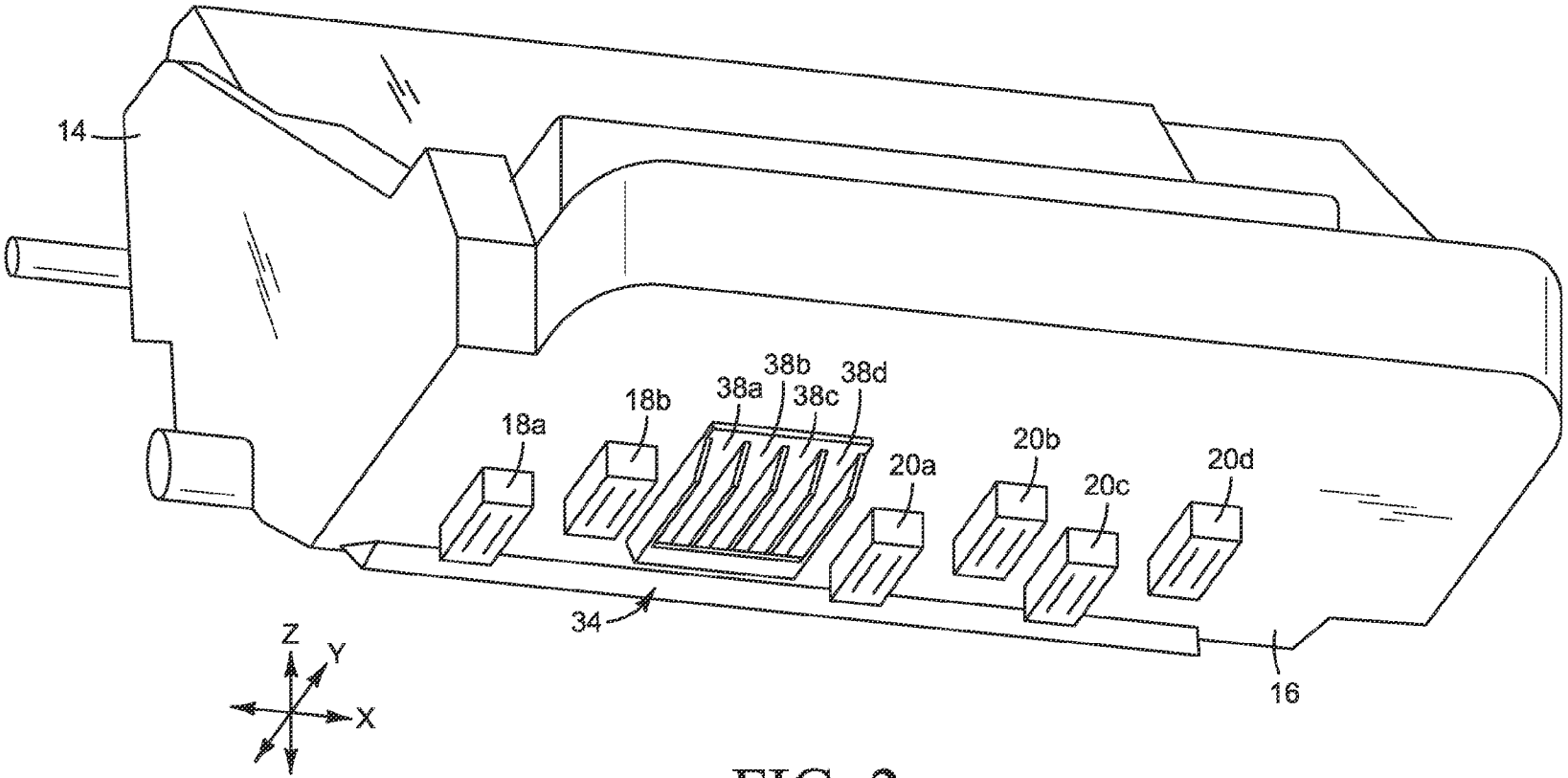
FIGS. 2 and 3 are perspective views of a printhead assembly implementing one example of a system for establishing an air barrier between printheads.
Figure 3:
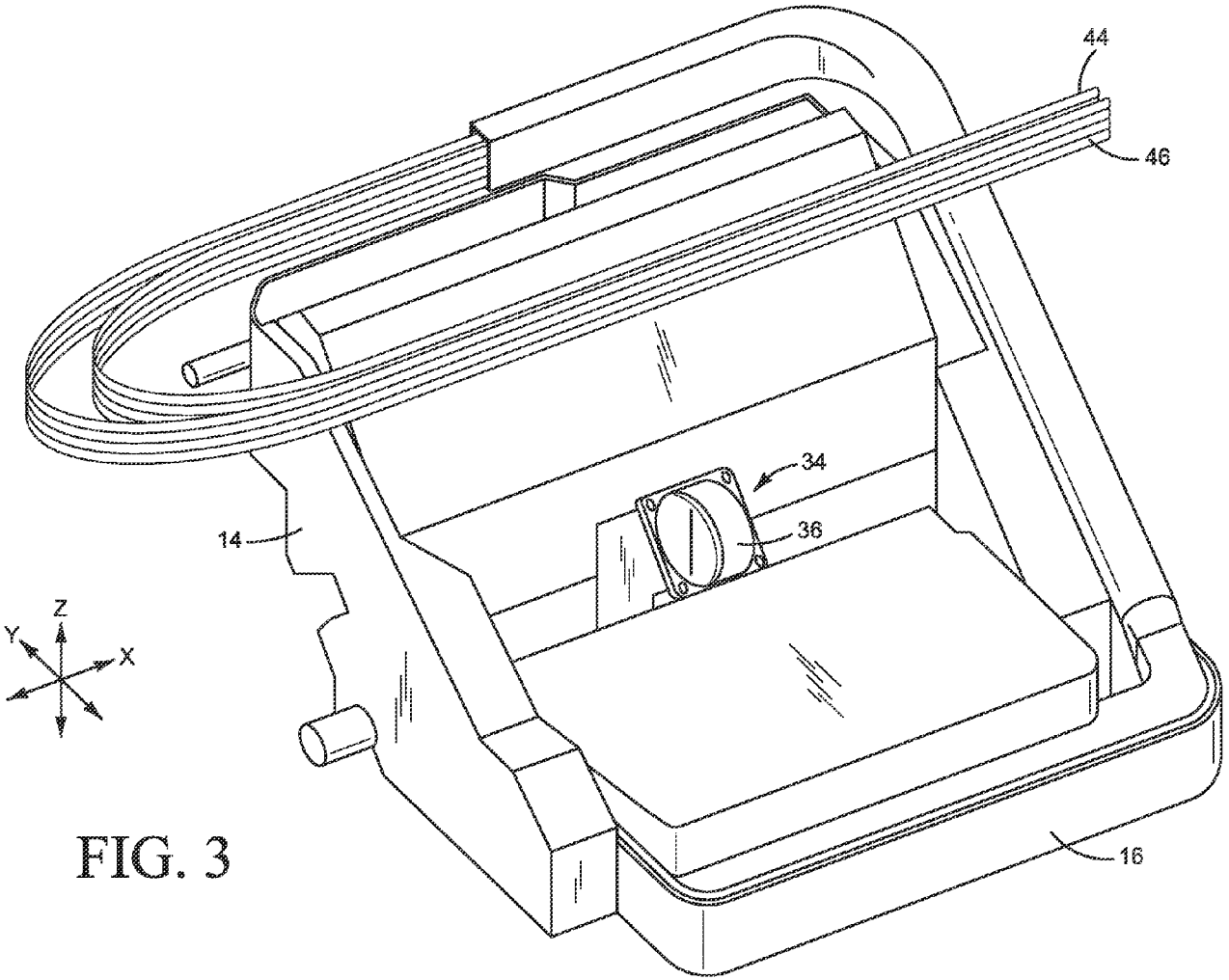
Figure 4:
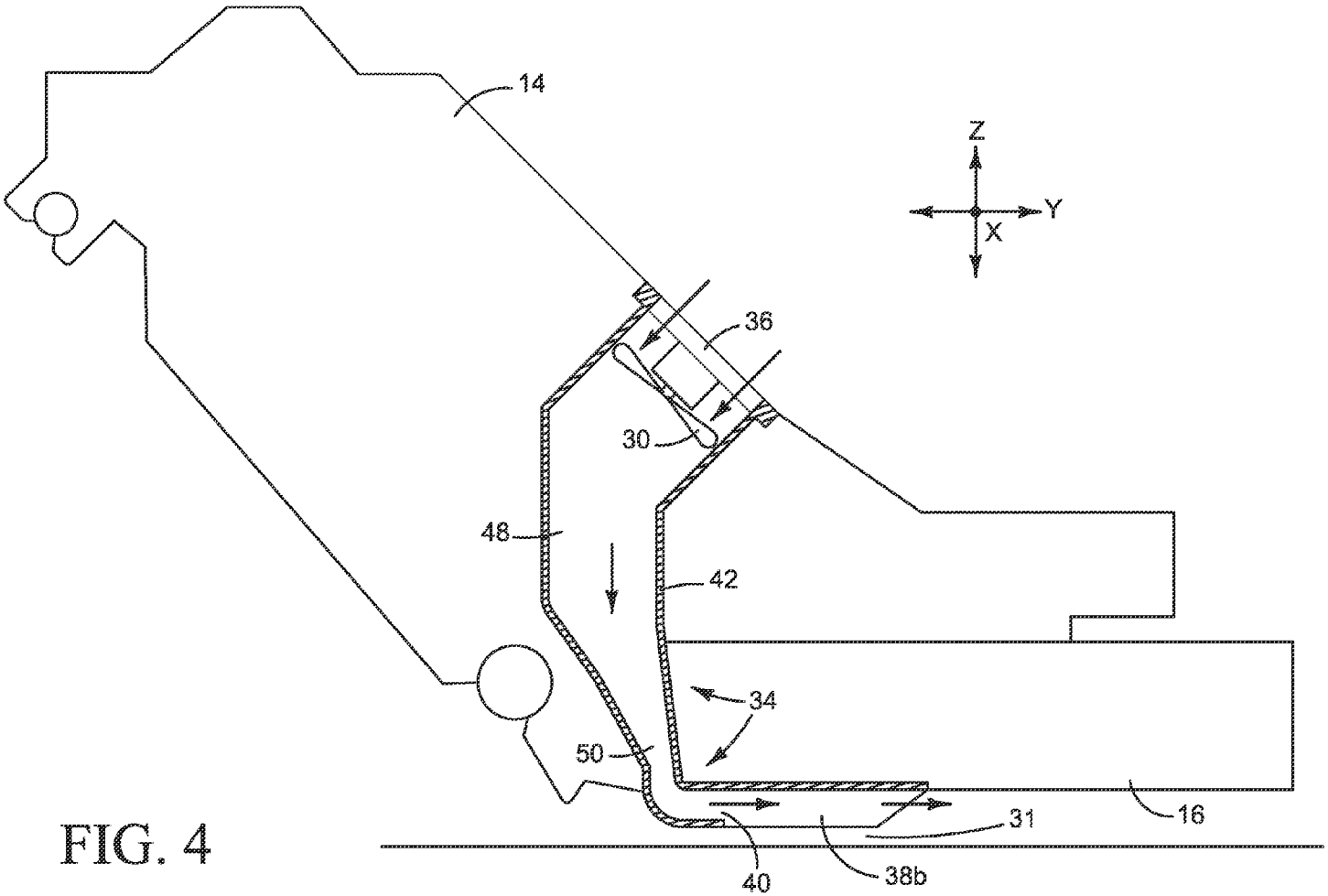
FIGS. 4 and 5 are side section and front elevation views, respectively, illustrating the air barrier system of FIGS. 2 and 3.
Figure 5:
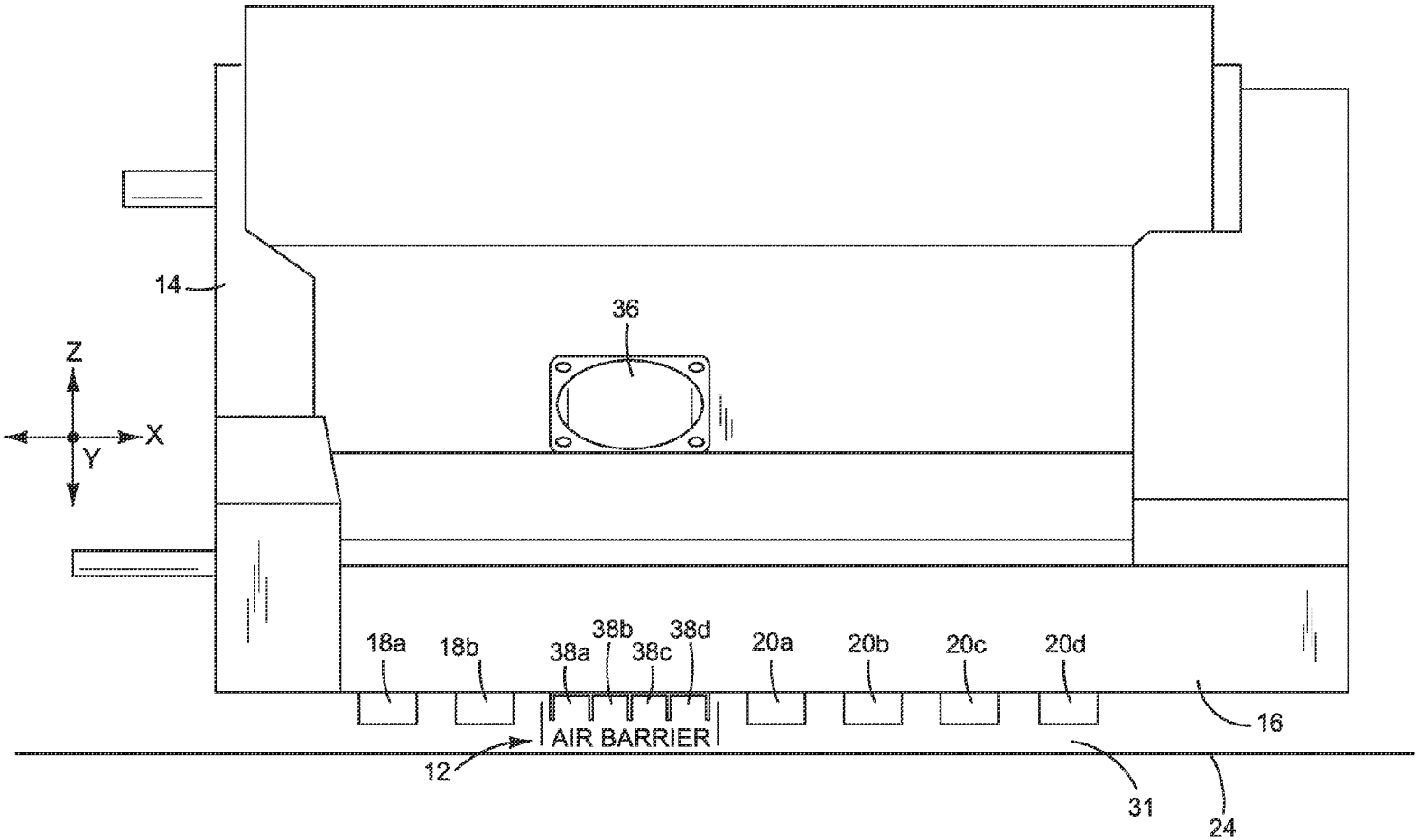

FIG. 1 is a block diagram illustrating one embodiment of an inkjet printer 10 implementing a new air barrier 12. FIGS. 2-5 illustrate one example of a system for establishing an air barrier 12 such as that shown in printer 10 in FIG. 1. FIGS. 2 and 3 are perspective views and FIGS. 4 and 5 are side section and front elevation views, respectively, of a printhead assembly implementing the air barrier system.

Referring first to FIG. 1, printer 10 includes a carriage 14 carrying a printhead assembly 16 with printheads 18, 20 and air barrier 12. A transport mechanism 22 advances a sheet of paper or other print substrate 24 past carriage 14 and printhead assembly 16. Printhead 18 is operatively connected to a supply 26 of treatment agent for dispensing the treatment agent on to print substrate 24. Printhead 20 is operatively connected to a supply 28 of ink for dispensing ink on to substrate 24. Although remote supplies 26 and 28 are shown, the treatment and ink supplies 26, 28 could be located on carriage 14.

As described in detail below, a fan 30 and associated air pathways are used to establish an air barrier 12 between treatment printhead 18 and ink printhead 20 during printing operations to help prevent mixing treatment aerosol and ink aerosol in the area of a print zone 31 near the printheads 18 and 20. Print zone 31 represents the region between printheads 18, 20 and substrate 24 through which the liquids, treatment agent and ink in this example, are dispensed toward substrate 24.

A controller 32 is operatively connected to carriage 14, printhead assembly 16 and substrate transport 22. Controller 32 represents generally the programming, processor and associated memory, and the electronic circuitry and components needed to control the operative elements of a printer 10. Controller 32 controls the movement of carriage 14 and substrate transport 22. Controller 32 is electrically connected to each printhead 18, 20 to selectively energize liquid ejection elements for dispensing treatment agent and ink on to substrate 24. By coordinating the relative position of carriage 14 with substrate 24 and the ejection of ink, controller 32 produces the desired image on substrate 24.

Referring now to FIGS. 2-5, an air barrier system 34 integrated into carriage 14 and printhead assembly 16 includes a fan 30 at an intake 36, channels 38A, 38B, 38C, 38D at a discharge 40, and ducting 42 that carries air from intake 36 to discharge 40. Intake 36 is located in an area of suitably clean air, for example in an area above printhead assembly 16 as shown in FIGS. 3-5. In the example shown in FIGS. 2-5, printhead assembly 16 includes a group of two treatment printheads 18A, 18B and a group of four ink printheads 20A, 20B, 20C, 20D. For a scanning carriage 14, treatment agent is supplied to printheads 18A, 18B and ink is supplied to printheads 20A-20D, for example, through flexible tubing 44 and 46, respectively, shown in FIG. 3. Tubing 44, 46 allows treatment agent and ink to be supplied to printhead assembly 16 from a separate supply station while still allowing carriage 14 to scan back and forth across print substrate 24. (According to the coordinate system shown in FIGS. 2-5, carriage 14 scans across substrate 24 in the X direction, substrate 24 moves in the Y direction, and printheads 18 and 20 dispense liquid in the Z direction.)

In general, channels 38A-38D are located between the treatment printheads 18A, 18B and the ink printheads 20A-20D. More specifically, channels 38A-38D are located between the nearest printheads in each group—treatment printhead 18B and ink printhead 20A in FIGS. 2 and 5. In the example shown in FIG. 4, ducting 42 narrows from a larger volume part 48 at intake 36 to a smaller volume part 50 at discharge 40 to accelerate the flow of air toward channels 38A-38D. Also, in the example shown in FIGS. 2 and 5, the air is channeled into four parallel air streams along channels 38A-38D to establish air barrier 12 between printheads 18B and 20A, and more generally between the two groups of printheads 18A, 18B and 20A-20D. While it may not be desirable in all implementations that the channels cover the full extent of the printing swath, it is expected that channels 38A-38D spanning substantially the full extent of the printing swath as shown in FIG. 2 will be desirable for many implementations to help ensure properly formed barrier air streams and to allow the channel structure itself to form at least a partial barrier between printheads.

For a printhead arrangement such as that shown in FIGS. 2 and 5 making a 2 inch printing swath with a 1.5 mm-3 mm printhead to substrate spacing, and a carriage scan speed up to 3 m/s, parameters typical of some large format inkjet printers, testing indicates that the following characteristics establish a sufficiently strong air barrier 12 to prevent any significant mixing of treatment agent and ink in print zone 31 without changing the trajectory of ink dispensed toward print substrate 24.

Air speed=5-10 m/s.

Number of Channels=3-6 channels.

Channel Width (X direction)=6-9 mm.

Channel Height (Z direction)=6-7 mm.

Channel Length (Y direction)=about 2 inches (printing swath)

Total Flow Volume=70-150 liters/minute.

For this printhead arrangement, air barrier 12 may be too weak to function effectively at lower air speeds and lower flow volumes while higher air speeds and higher flow volumes create too high a risk of changing the trajectory of ink dispensed toward substrate 24 and/or of inducing undesired turbulences into the print zone. Fewer than three channels tends to allow the air stream(s) to spread, reducing the effectiveness of the barrier, and more than six channels may not improve an already effective barrier. However, the characteristics of air barrier 12 and the size and shape of the components of air barrier system 34 may vary from those described above depending on the particular printhead arrangement in which the air barrier is implemented.

Figure 6:
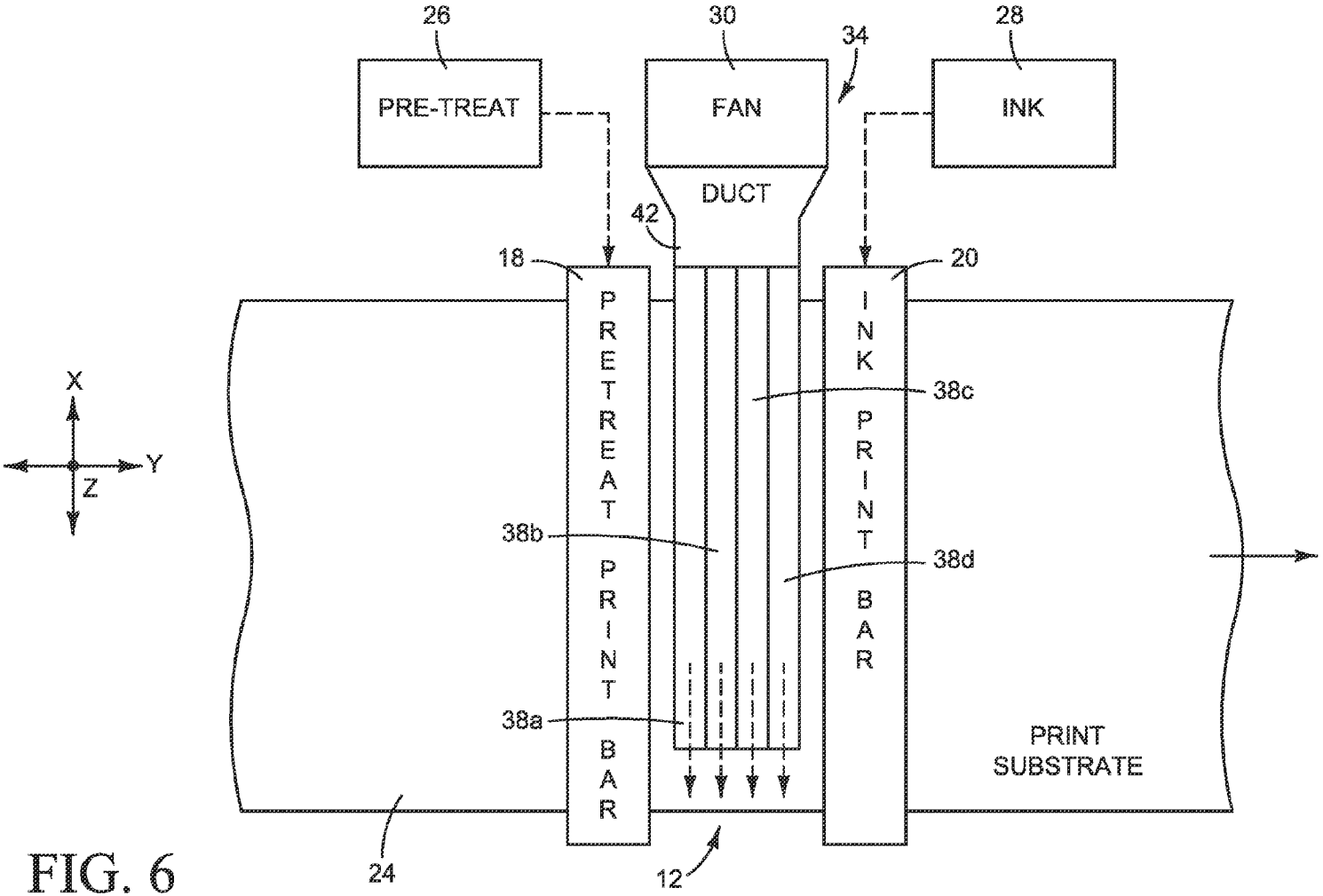
FIG. 6 illustrates an inkjet printer with stationary, substrate wide print bars implementing one example of a new air barrier system.

In an alternative implementation shown in FIG. 6, printer 10 includes a stationary, substrate wide print bar 18 for dispensing a pretreatment agent on to a print substrate 24 and a stationary, substrate wide print bar 20 for dispensing ink on to substrate 24. Each print bar 18, 20 includes one or more printheads (not shown) spanning the width of substrate 24. The printhead(s) on pretreatment print bar 18 are connected to a supply 26 of pretreatment agent. The printhead(s) on ink print bar 20 are connected to a supply 28 of ink. Air barrier system 34 includes a fan 30, channels 38A, 38B, 38C, 38D, and ducting 42 that carries air from fan 30 to channels 38A-38D. In this example of an air barrier system 34, channels 38A-38D channel multiple air streams across substantially the entire width of substrate 24 to establish an air barrier 12 between print bars 18 and 20 along the full extent of the printheads in each substrate wide print bar 18, 20.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. An air barrier system for a printhead assembly having multiple printheads for dispensing liquid on to a substrate positioned to receive liquid dispensed from the printheads, the air barrier system comprising:

a source of pressurized air; and multiple channels interposed between two adjacent printheads and extending over a substrate when the substrate is positioned to receive liquid dispensed from the printheads, the channels operatively connected to the air source to channel multiple streams of air between the two printheads.

2. The system of claim 1, wherein there are 3-6 channels each to channel a corresponding stream of air between the two printheads.

3. The system of claim 2, wherein each channel is 6-9 mm wide and 6-7 mm high.

4. The system of claim 1, further comprising a duct operatively connected between the air source and the channels.

5. The system of claim 4, wherein the duct includes a larger, upstream part and a smaller, downstream part for accelerating the flow of air toward the channels.

6. An inkjet printhead assembly, comprising:

a movable carriage;

a first printhead on the carriage for dispensing a first liquid;

a second printhead on the carriage for dispensing a second liquid; and a plurality of channels on the carriage and configured to channel air between the two printheads on the carriage.

7. The printhead assembly of claim 6, wherein the channels are located on the carriage between the two printheads.

8. The printhead assembly of claim 7, wherein each air channel is immediately adjacent and parallel to one of the other air channels to channel each of a corresponding plurality of air streams between the two printheads.

9. The printhead assembly of claim 8, further comprising:

a fan; and a duct operatively connected between the fan and the air channels.

10. The printhead assembly of claim 9, wherein the fan, duct, and channels are configured together to channel 70-150 liters/minute of air between the two printheads.

11. A printhead assembly, comprising:

a first printhead for dispensing a first liquid;

a second printhead next to the first printhead for dispensing a second liquid;

multiple channels to form a barrier of moving air between the first printhead and the second printhead; and one of the printheads and the channels on a movable carriage with the channels extending between the printheads in a direction substantially perpendicular to a direction of carriage movement, or the first printhead on an elongated first print bar, the second printhead on an elongated second print bar, and the channels extending lengthwise between the first print bar and the second print bar.

12. The printhead assembly of claim 11, wherein the printheads and the channels are on a movable carriage with the channels extending between the printheads in a direction substantially perpendicular to a direction of carriage movement.

13. The printhead assembly of claim 11, wherein the first printhead is on an elongated first print bar, the second printhead is on an elongated second print bar, and the channels extend lengthwise between the first print bar and the second print bar.

14. The printhead assembly of claim 11, where each channel extends along a full length of at least one of the printheads.

* * * * *